US007708587B2

(12) United States Patent
Wu

(10) Patent No.: US 7,708,587 B2
(45) Date of Patent: May 4, 2010

(54) DAISY CHAIN CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 43 days.

(21) Appl. No.: 12/231,640

(22) Filed: Sep. 3, 2008

(65) Prior Publication Data

US 2010/0055983 A1 Mar. 4, 2010

(51) Int. Cl.
*H01R 12/24* (2006.01)

(52) U.S. Cl. ..... 439/492; 439/498

(58) Field of Classification Search ..... 439/492, 439/498, 638, 626

See application file for complete search history.

(56) References Cited

U.S. PATENT DOCUMENTS 5,855,064 A 1/1999 Chang

*Primary Examiner*—Briggitte R Hammond
(74) *Attorney, Agent, or Firm*—Wei Te Chung; Andrew C. Cheng; Ming Chieh Chang

(57) ABSTRACT

A cable assembly (100) includes at least two connectors (10, 20), each connector including an insulated housing (11) and a plurality of power contacts (115) supported by the insulated housing; two printed circuit boards (12, 22) respectively disposed rearward of the two connectors, and tail portions of the power contacts respectively soldered to the two printed circuit boards; and a plurality of power wires (14, 24) including one set of the power wires each having two opposite ends soldered to the two printed circuit board to connected the two connector (10, 20) together and the other set of power wires soldered to one of the two printed circuit board and further adapted for coupling to a power source such that the two connectors are capable of being powered by same power transmitting lines.

20 Claims, 8 Drawing Sheets

DAISY CHAIN CABLE ASSEMBLY

FIELD OF THE INVENTION

The present invention generally relates to cable assembly, and more particularly to a cable assembly which includes a number of connectors linked together by cables in a serial manner.

DESCRIPTION OF PRIOR ART

The quality of a power supply is a key factor of determining stable operation and quality of a computer system. With the progress of science and technology, the quality demand for the power supply of the electronic device also grows higher and higher. The quality of overall power output will be decayed owing to the quality instability of inputting power source, which will induce the electronic device to stop operating and the computer system to stop working, and thus, important data or information will be lost.

In addition to power quality, the cable management of the power cable is also a big trouble. For example, U.S. Pat. No. 5,855,064 issued to Chang on Jan. 5, 1999 discloses a power supply system with modularized and integrated cable interface configuration for providing power from a power source to a plurality of subsystems in a personal computer. The power supply system includes a power cable for connecting the power supply system to the external power source. The power supply system further includes an output (O/P) cable having a first end and second end, the O/P cable including a plurality of cable groups wherein each of the cable groups including a subsystem plug module on the first end for connecting to corresponding PC subsystems. The power supply system further includes an integrated PC receptive module for providing an interface with the O/P cable. The O/P cable further including an integrated O/P cable plug module on the second end for plugging the O/P cable into the integrated receptive module, wherein the integrated O/P plug module being in electric connection to each of the cable groups.

However, the interior space of a general computer is limited, and the cable groups occupy too much space, which will influence the management of the redundant cables. Further, lacking effective management of the redundant cables results in that the heat-dissipating air flow cannot be effectively guided which incurs inferior heat dissipation and influences the efficacy of the computer.

Hence, an improved cable assembly for power supply is highly desired to overcome the aforementioned problems.

SUMMARY OF THE INVENTION

Accordingly, an object of the present invention is to provide a cable assembly which has a better cable management to reduce redundant cables.

In order to achieve the object set forth, a cable assembly in accordance with the present invention comprises at least two connectors, each connector including an insulated housing and a plurality of power contacts supported by the insulated housing; two printed circuit boards respectively disposed rearward of the two connectors, and tail portions of the power contacts respectively soldered to the two printed circuit boards; and a plurality of power wires including one set of the power wires each having two opposite ends soldered to the two printed circuit board to connected the two connector together and the other set of power wires soldered to one of the two printed circuit board and further adapted for coupling to a power source such that the two connectors are capable of being powered by same power transmitting lines.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
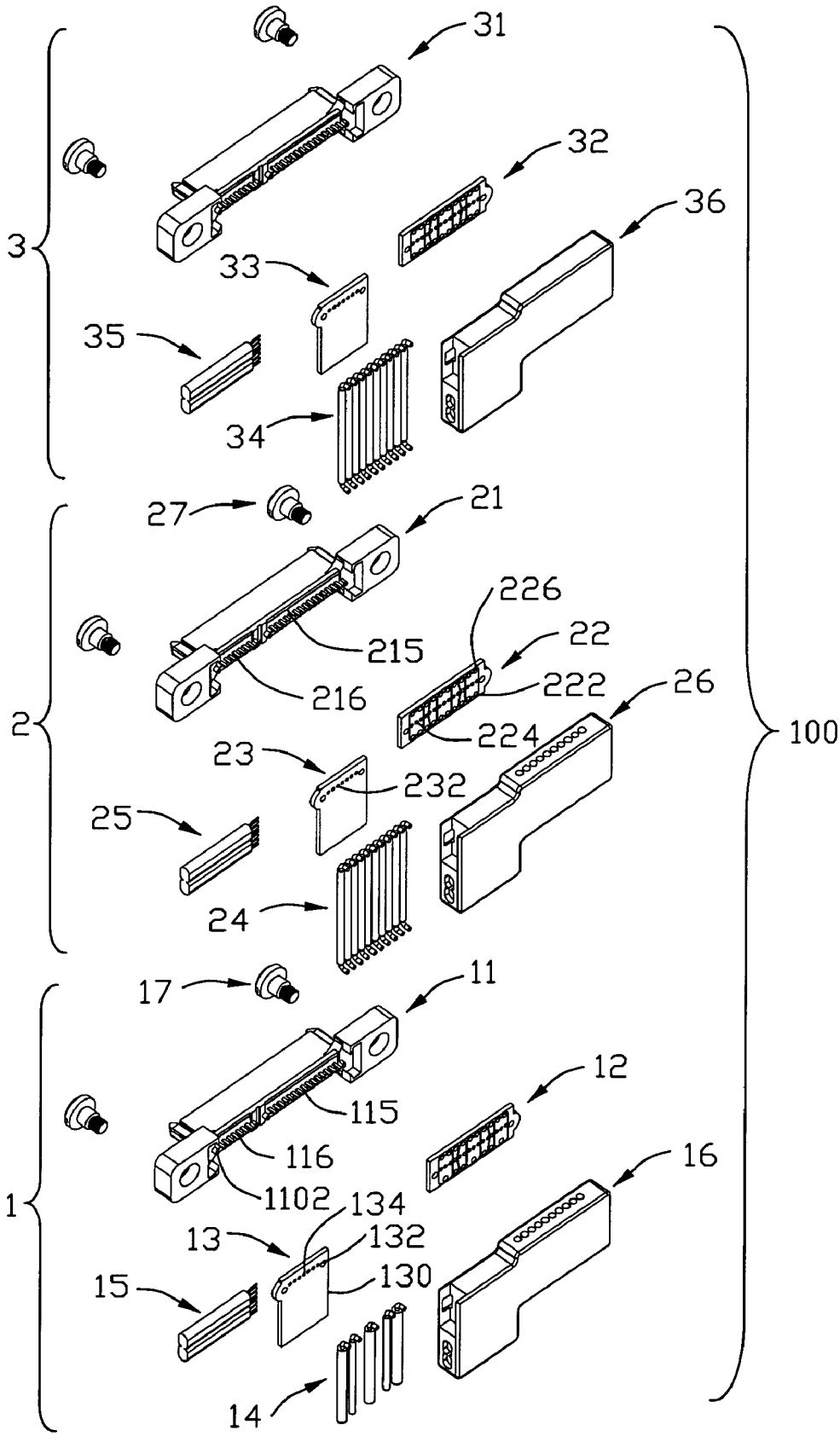
FIG. 1 is an exploded, perspective view of a cable assembly in accordance with the present invention.
Figure 2:
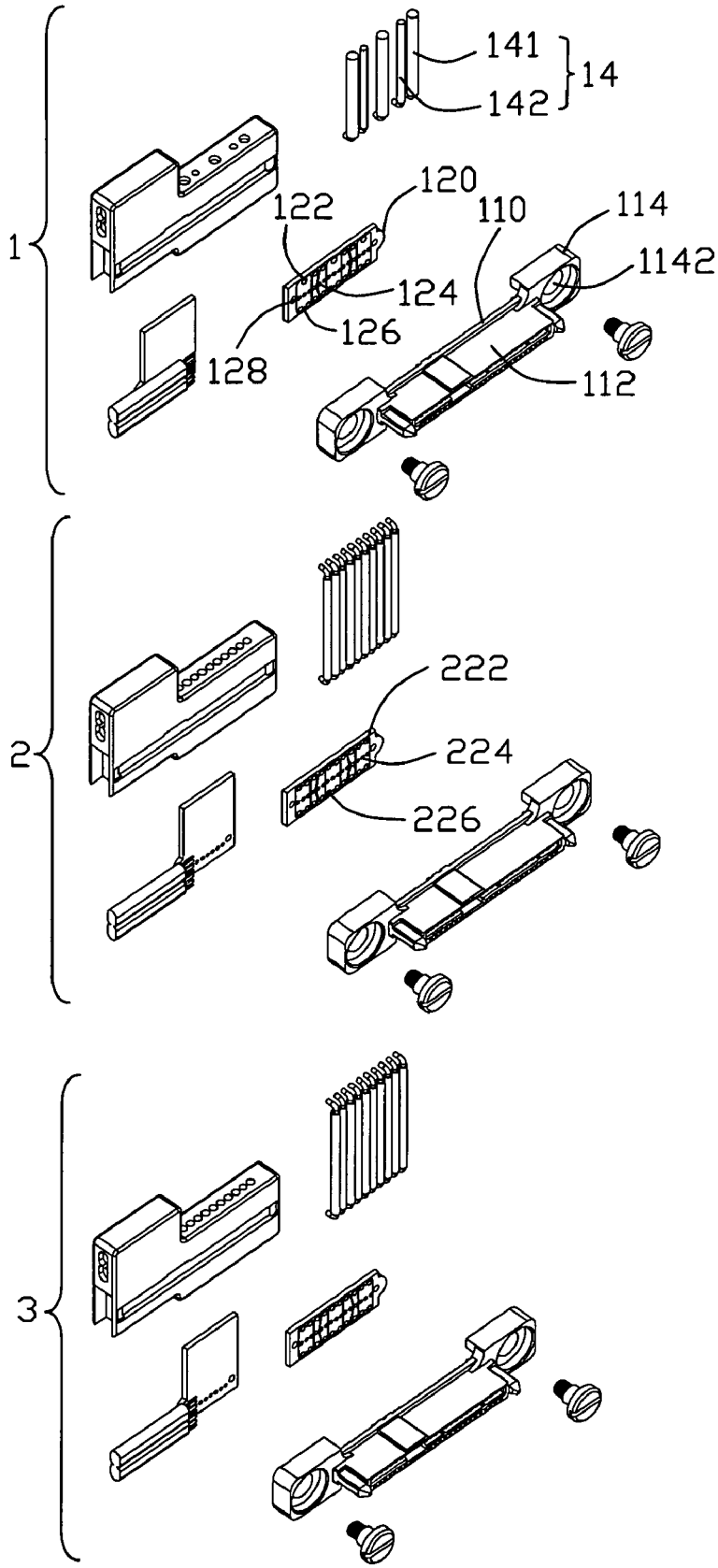
FIG. 2 is similar to FIG. 1, but viewed from another aspect.
Figure 3:
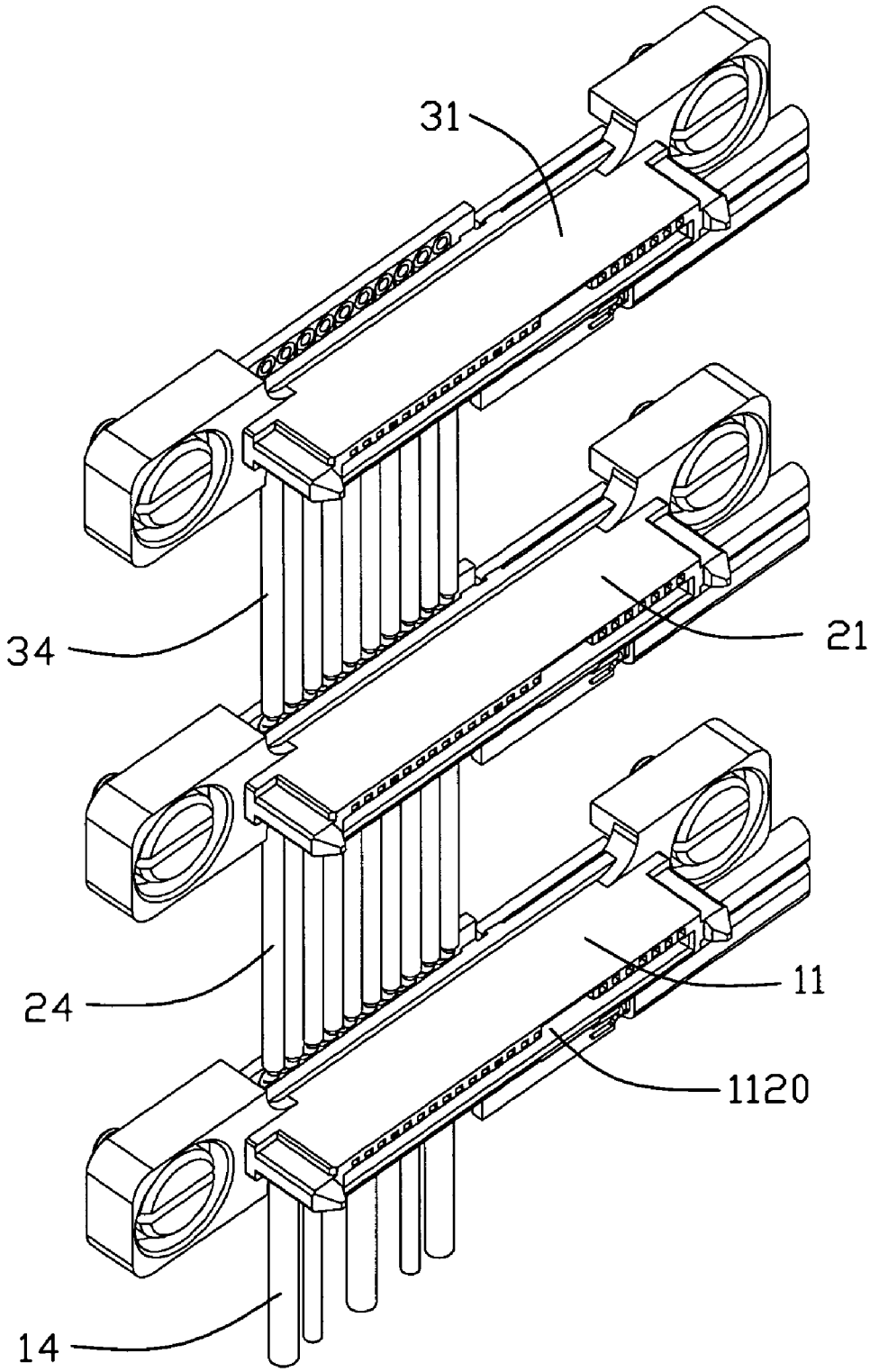
FIG. 3 is a partially assembled, perspective view of the cable assembly.
Figure 4:
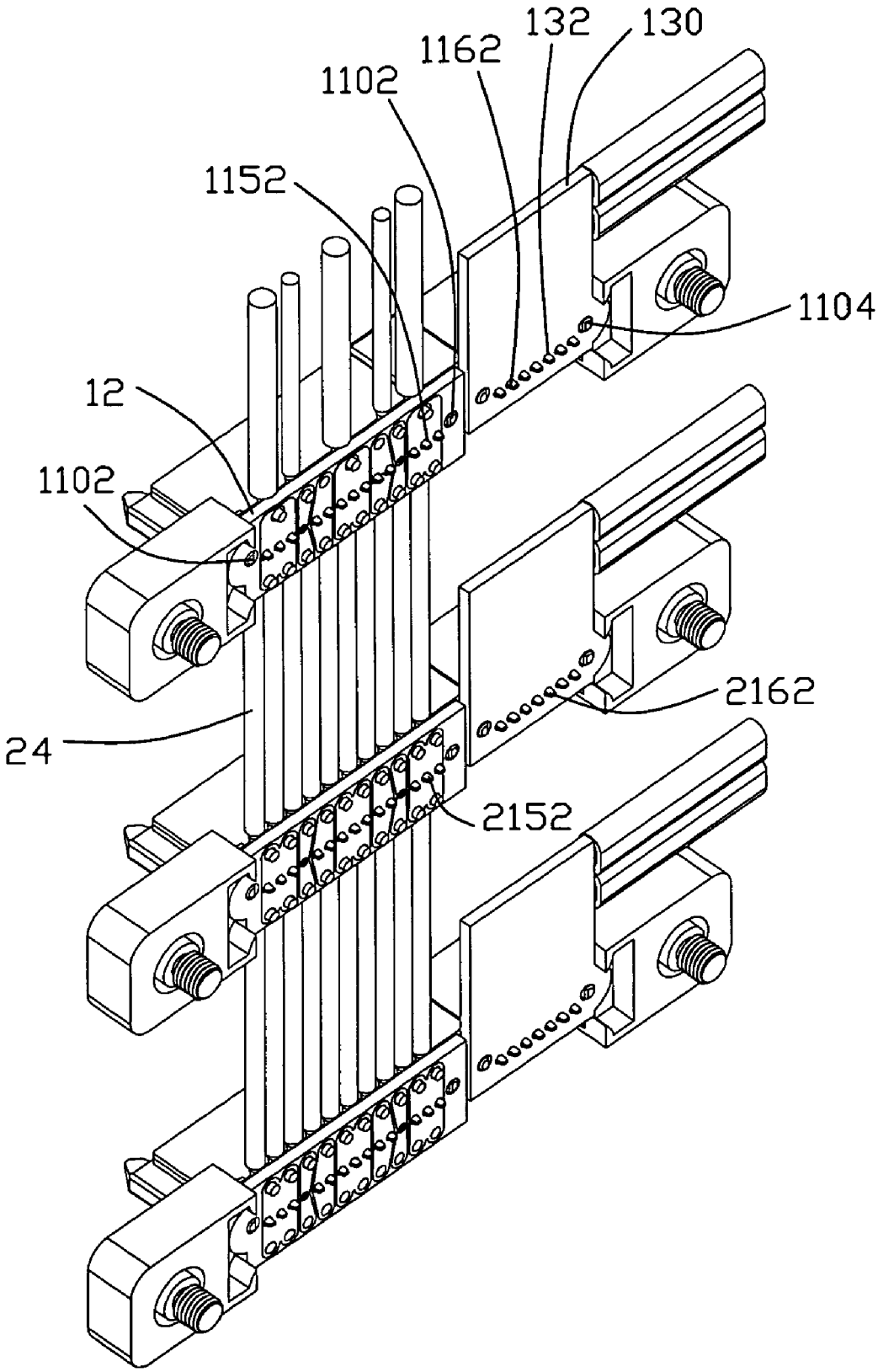
FIG. 4 is similar to FIG. 1, but viewed from another aspect.
Figure 5:
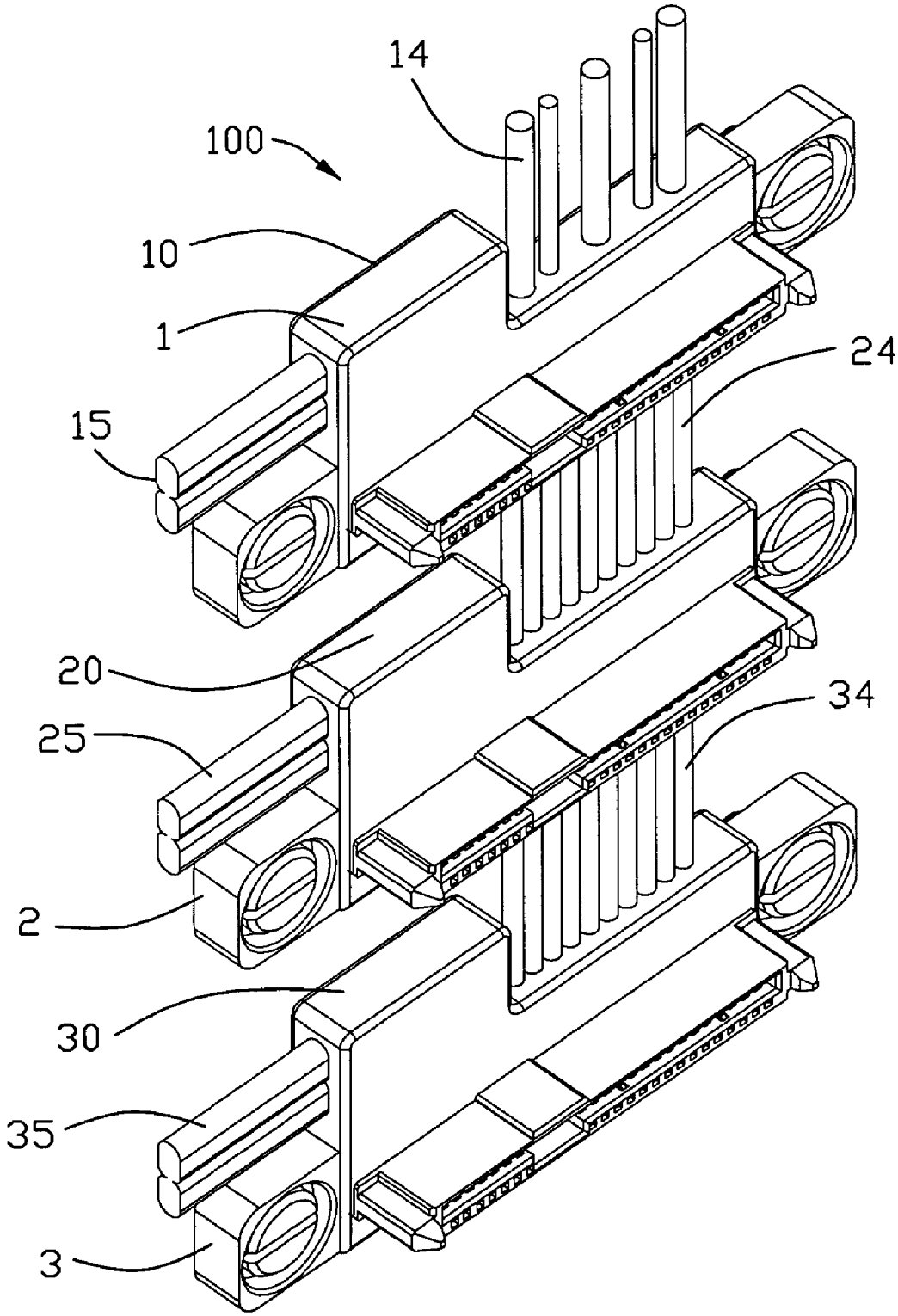
FIG. 5 is an assembled, perspective view of the cable assembly.
Figure 6:
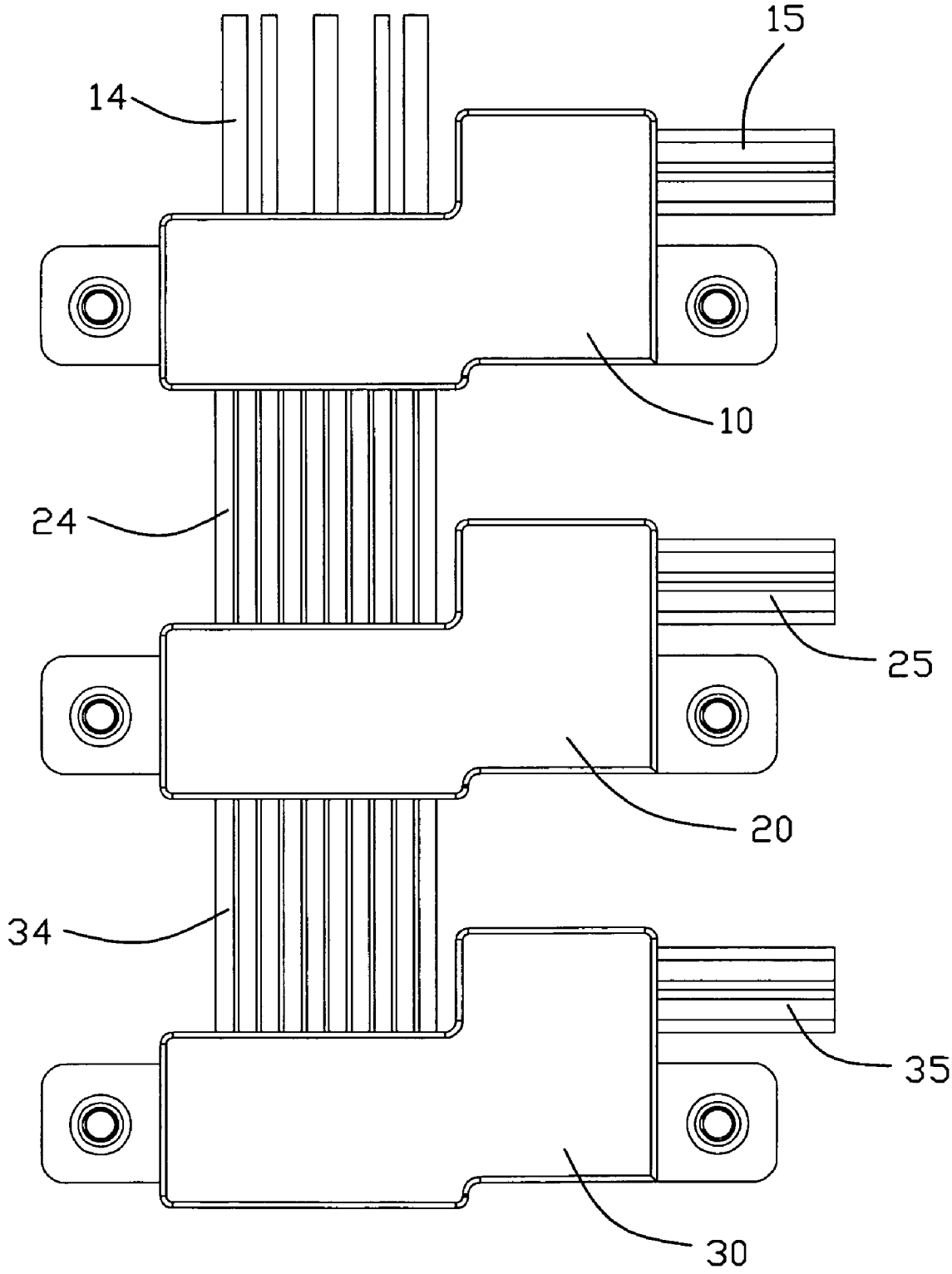
FIG. 6 is a rear elevational view of the cable assembly.
Figure 7:
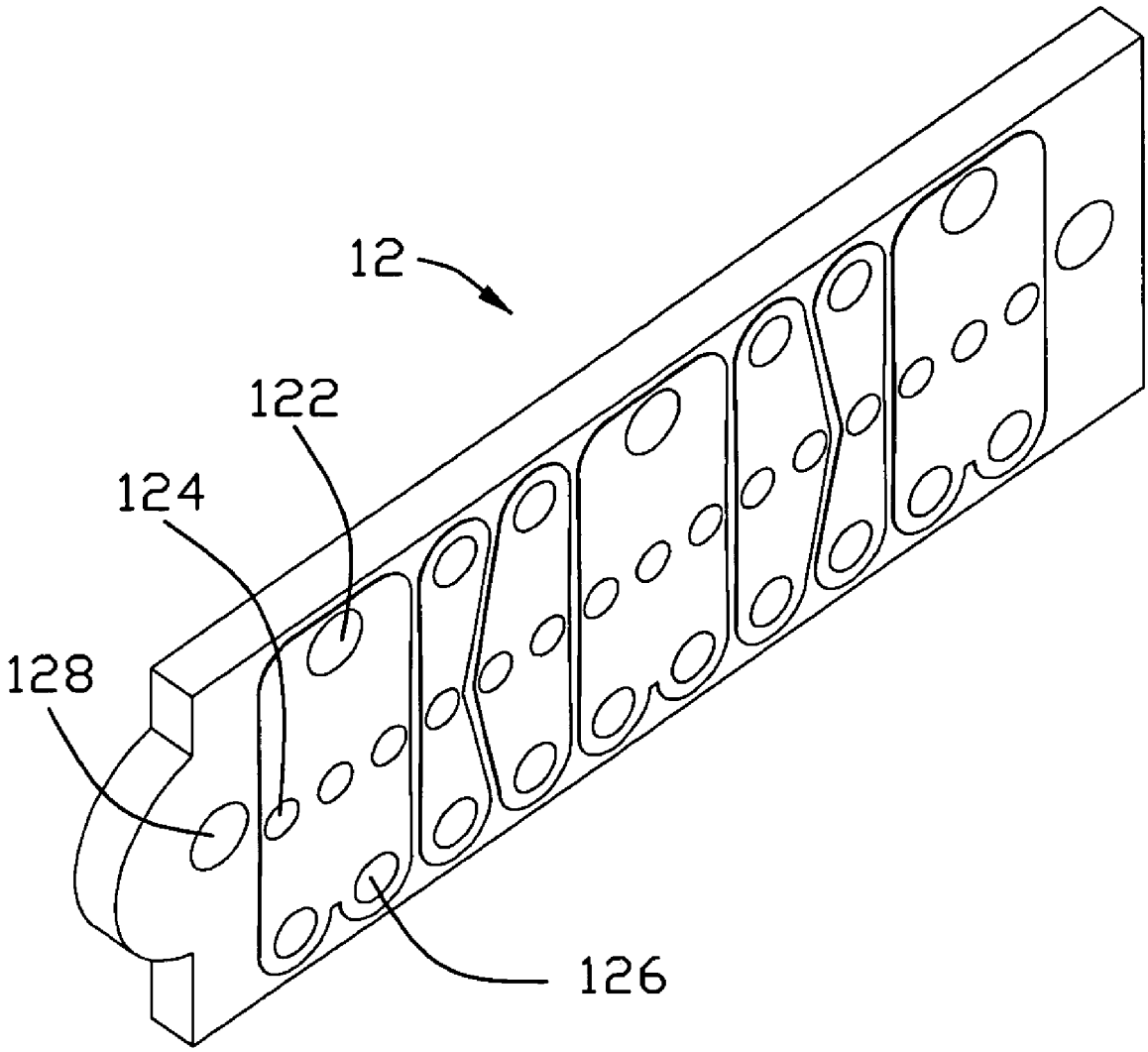
FIG. 7 is an enlarged view of a first printed circuit board of a first cable assembly.
Figure 8:
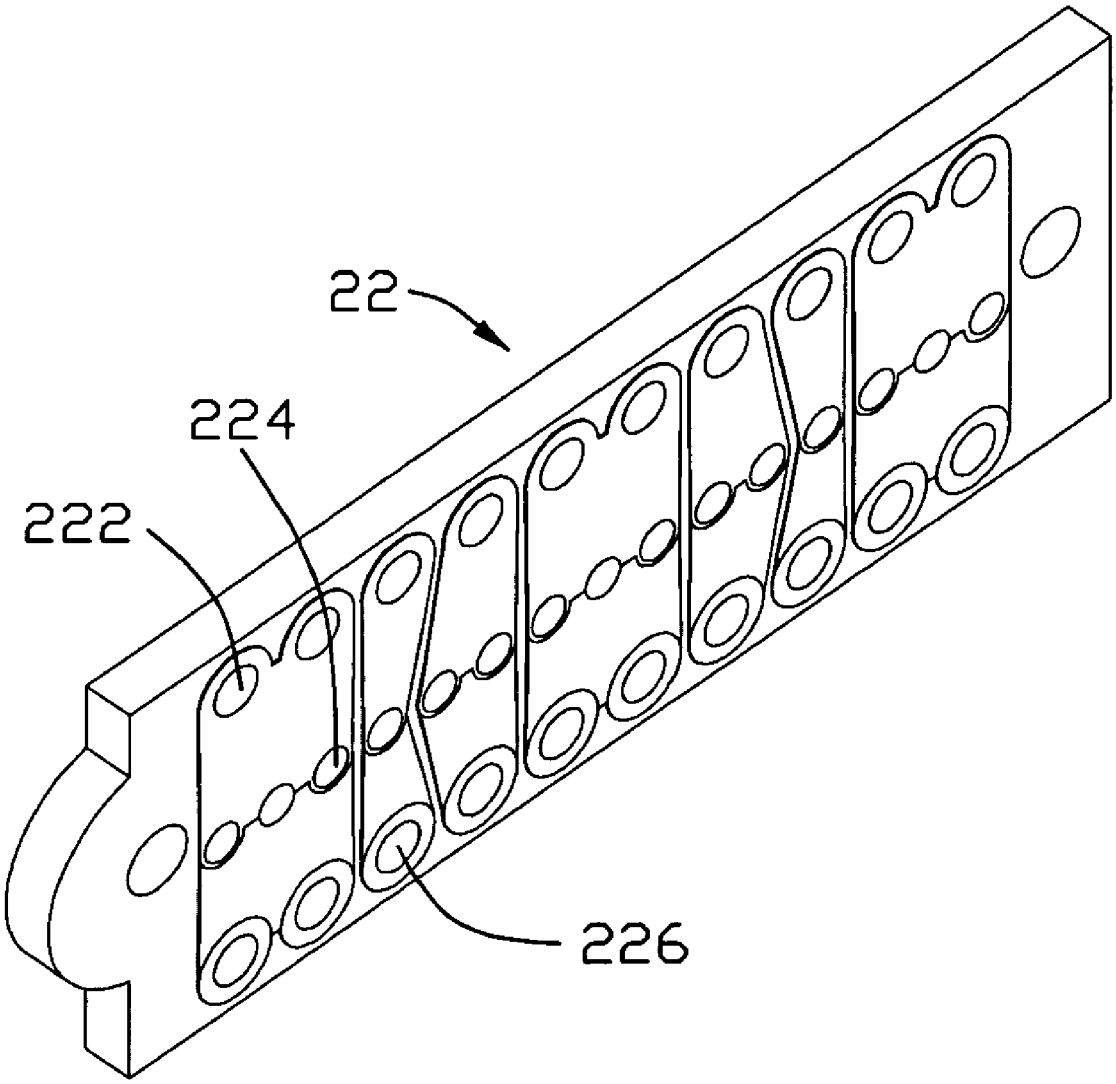
FIG. 8 is an enlarged view of a first printed circuit board of a second cable assembly.

Referring to FIGS. 1-8, a cable assembly 100 in accordance with the present invention comprises a first cable assembly 1, a second cable assembly 2 and a third cable assembly 3 interconnected one another serially.

The first cable assembly 1 comprises a connector 10 and a number of power wires 14 and signal wires 15 coupled to the connector 10. The connector 10 includes an insulated housing 11, a first printed circuit board (PCB) 12, a second PCB 13, a plurality of power contacts 115 and signal contacts 116 supported by the insulated housing 11.

The insulated housing 11 includes an elongated base portion 110, a mating portion 112 extending forwardly from the base portion 110, and a pair of mounting portions 114 formed at lateral sides of the base portion 110. The mating portion 112 has a plurality of walls (not numbered) interconnected one another to form a receiving space 1120 thereamong. The power contacts 115 and signal contacts 116 extends into the receiving space 1120 from the base portion 110, with tail portions 1152, 1162 thereof disposed outward of a back face of the base portion 110. Each mounting portion 114 further has an aperture 1142 therein for assembling a corresponding screw 17.

The first PCB 12 has a circuit substrate 120, a set of first conductive holes 122, a set of second conductive holes 124 and a set of third conductive holes 126. The first conductive holes 122 and third conductive holes 126 are respectively arranged at an upper section and a lower section of the circuit substrate 120, while the second conductive holes 126 are arranged in a middle section of the circuit substrate 120. The set of first conductive holes 122, the set of second conductive holes 124 and the set of third conductive holes 126 are parallel to one another along a vertical direction. The number of the first conductive holes 122 is less than that of the third conductive holes 126, and the number of the third conductive holes 126 is less than that of the second conductive holes 124. Two positioning holes 128 are defined in the lateral sides of the circuit substrate 120 for receiving corresponding posts 1102 projected backwardly from the back face of the base portion 110.

The second PCB 13 has a circuit substrate 130, a group of conductive holes 132 are defined in a lower section thereof and a number of conductive pads (not shown) are formed on an upper section of a lateral side of the circuit substrate 130. Two positioning apertures 134 are arranged at lateral sides of a lower section of the circuit substrate 130 to receive positioning poles 1104 formed at the back surface of the base portion 110.

The power wires 14 are hybrid typed wires which includes three first power wires 141 and two second power wires 142. Each first power wire 141 is thicker than the second power wire 142. A current passes the first wire 141 is about 4.5 A, while a current passes the second wire 142 is about 1.5 A. Each first power wire 141 or second power wire 142 has an inner conductor (not numbered) enclosed within an outer jacket (not numbered).

The tail portions 1152, 1162 of the power contacts 115 and signal contacts 116 are inserted into the second conductive holes 124 of the first PCB 12 and the conductive holes 132 of the second PCB 13, and are further soldered therein. Front sections of the inner conductors of the power wires 14 are inserted into the first conductive holes 122 and soldered therein. The signal wires 15 are soldered to the conductive pads of the second PCB 13 and extend laterally. Therefore, the power wires 14 are perpendicular to the signal wires 15.

The second cable assembly 2 is same as the third cable assembly 3. The second cable assembly 2 is similar to the first cable assembly too, except for some minor differences and a detailed description of the other same elements and structures are omitted hereby. The second cable assembly 2 has a first PCB 22 similar to the first PCB 12, except that the number of first conductive holes 222 is more than that of the first PCB 12. The second cable assembly 2 also has a group power wires 24, except that a diameter of each of them is identical and thinner than that of the first power wire 141. Furthermore, the number of power wires 24 of the second cable assembly 2 is more than the power wires 14 of the first cable assembly 1. The power wires 24 are more flexible than the power wires 14.

Opposite ends of each power wire 24 are respectively inserted into the corresponding third conductive hole 126 of the first PCB 12 and a first conductive holes 222 of the first PCB 22 and soldered therein, while tail portions 2152 of power contacts 215 are inserted into second conductive holes 224 of the first PCB 22. Tail portions 2162 of signal contacts 216 are inserted into conductive holes 232 of second PCB 23, and signal wires 25 are soldered to conductive pads (not shown) of the second PCB 23 and extend laterally therefrom. Thus, the first connector 11 is coupled to a second connector 21 via the power wires 24.

Similarly, a third connector 31 interconnected with the second connector 21 via a first PCB 32 and a group of power wires 34 by same manner, and signal wires 35 are soldered to a second PCB 33 and extend laterally therefrom. Detailed description is omitted hereby.

Three insulators 16, 26, 36 are respectively molded over rear portions of the first, second and third connectors 11, 21, 31, the first PCBs 12, 22, 32, the second PCBs 13, 23, 33, and end sections of the power wires 14, 24, 34 and signal wires 15, 25, 35 adjacent the rear portions of the first, second and third connectors 11, 21, 31.

The first, second and third connectors 11, 21, 31 interconnected one another serially by power wires 24, 34 and all powered by the same power wires 14 which is coupled to a power source (not shown), while the signal wires 15, 25, 35 are respectively connected to the first, second and third connectors 11, 21, 31 in parallel manner. That is to say, the first, second and third connectors 11, 21, 31 are capable of being powered by same power transmitting lines, and by such arrangement, it can greatly reduce redundant cables for power supply.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

at least two connectors, each connector including an insulated housing and a plurality of power contacts supported by the insulated housing;

two printed circuit boards respectively disposed rearward of the two connectors, and tail portions of the power contacts respectively soldered to the two printed circuit boards; and a plurality of power wires including one set of the power wires each having two opposite ends soldered to the two printed circuit board to connected the two connector together and the other set of power wires soldered to one of the two printed circuit board and further adapted for coupling to a power source such that the two connectors are capable of being powered by same power transmitting lines.

2. The cable assembly as recited in claim 1, wherein each of the two printed circuit board has three sets of conductive holes and the tail portions of the power contacts are inserted into the corresponding conductive holes defined in a middle section of the printed circuit board.

3. The cable assembly as recited in claim 2, wherein opposite ends of inner conductors of the one set of power wires are inserted into the two sets of conductive holes respectively defined in a lower and an upper sections of the two printed circuit boards.

4. The cable assembly as recited in claim 3, wherein inner conductors of the other set of power wires are inserted into the conductive holes defined in an upper section or a lower section of one of the two printed circuit boards.

5. The cable assembly as recited in claim 1, wherein two insulators are respectively molded over rear portions of the two connectors, the two printed circuit boards and end portions of the wires adjacent to the two printed circuit boards.

6. The cable assembly as recited in claim 1, wherein the one set of power wires align with the other set of power wires along a vertical direction.

7. The cable assembly as recited in claim 1, wherein the one set of power wires are different from the other set of power wires.

8. The cable assembly as recited in claim 7, wherein the number of the one set of power wires is more than that of the other set of power wires.

9. The cable assembly as recited in claim 7, wherein each of the one set of power wires has an identical diameter.

10. The cable assembly as recited in claim 7, wherein the other set of power wires are hybrid-typed wires which include at least two different dimensioned wires.

11. A cable assembly, comprising:

at least two connectors, each connector including an elongated insulated housing;

a plurality of power contacts and signal contacts received in the insulated housing of each connector;

a plurality of power wires electrically connected to tail portions of the power contacts to have the two connectors linked together serially; and a plurality of signal wires separated into two groups and respectively connected to tail portions of the signal contacts.

12. The cable assembly as recited in claim 11, wherein the power wires are perpendicular to the signal wires.

13. The cable assembly as recited in claim 11, wherein a first and a second printed circuit boards are attached to a rear surface of the insulated housing of each connector.

14. The cable assembly as recited in claim 13, wherein the first printed circuit board defines a plurality of conductive holes receiving tail portions of the power contacts and end portions of power wires.

15. The cable assembly as recited in claim 13, wherein the second printed circuit board defines a plurality of conductive holes in lower or upper sections thereof receiving tail portions of the signal contacts and a number of conductive pads arranged at a lateral section thereof soldered to the signal wires.

16. The cable assembly as recited in claim 11, wherein two mounting portions are respectively arranged at lateral sides of the insulated housing.

17. A cable connector assembly comprising:

at least first and second connectors, each of said first and second connectors defining signal and power regions thereof, a plurality of signal contacts and a plurality of power contacts disposed in the signal region and the power region, respectively;

first and second signal cables being electrically independent from each other and being of essentially a parallel connection manner with each other, each including a plurality of signal wires connected to the corresponding signal contacts, respectively; and first and second power cables being electrically dependent on each other and being of essentially a serial connection manner with each other, each including a plurality of power wires connected to the corresponding power contacts, respectively.

18. The cable connector assembly as claimed in claim 17, wherein the second power cable simultaneously connects the power regions of both said first connector and said second connector.

19. The cable connector assembly as claimed in claim 17, wherein the power region and the signal region define corresponding mating ports for respectively mating with mating portions of at least one complementary connector.

20. The cable connector assembly as claimed in claim 17, wherein each of said first and second connectors defines a lengthwise direction and width direction, and wherein the first and second power cables extend in the width direction while the signal cables extend along the lengthwise direction.

* * * * *